US006065762A

United States Patent [19]

Brelvi

[11] Patent Number: 6,065,762

[45] Date of Patent: May 23, 2000

[54] MULTIDIRECTIONAL IN-LINE ROLLER SKATE

[76] Inventor: Nazir A Brelvi, 37 Sandpiper Dr., Hackettstown, N.J. 07840

[21] Appl. No.: 09/038,521

[22] Filed: Mar. 11, 1998

[51] Int. Cl.[7] ..... A63C 17/02

[52] U.S. Cl. ..... 280/11.22; 280/843; 280/11.28

[58] Field of Search ..... 280/11.19, 11.22, 280/11.27, 11.28, 11.32, 843, 11.3, 842, 844

[56] References Cited

U.S. PATENT DOCUMENTS

| | | | |
|---|---|---|---|
| D. 301,906 | 6/1989 | Coolen . | |
| D. 315,941 | 4/1991 | Olson et al. . | |
| D. 321,393 | 11/1991 | Olson et al. . | |
| D. 323,540 | 1/1992 | Graham . | |
| D. 324,713 | 3/1992 | Rubin . | |
| D. 327,360 | 6/1992 | Graham . | |
| D. 327,565 | 7/1992 | Graham . | |
| D. 339,672 | 9/1993 | Olson . | |
| D. 346,192 | 4/1994 | Miller et al. . | |
| 1,043,958 | 11/1912 | Mollinger . | |
| 1,616,442 | 2/1927 | Festenburg et al. | 280/843 |
| 3,936,061 | 2/1976 | Wada . | |
| 4,034,995 | 7/1977 | Forward et al. . | |
| 4,295,655 | 10/1981 | Landay et al. | 280/11.2 |
| 4,328,627 | 5/1982 | Sanders | 36/115 |
| 4,624,063 | 11/1986 | Delery . | |
| 4,909,523 | 3/1990 | Olson . | |
| 4,915,399 | 4/1990 | Marandel | 280/11.28 |
| 5,028,058 | 7/1991 | Olson . | |
| 5,048,848 | 9/1991 | Olson et al. . | |
| 5,052,701 | 10/1991 | Olson . | |
| 5,067,736 | 11/1991 | Olson et al. . | |
| 5,068,956 | 12/1991 | Malewicz . | |
| 5,092,614 | 3/1992 | Malewicz . | |
| 5,171,033 | 12/1992 | Olson et al. . | |
| 5,253,883 | 10/1993 | Moldenhauer . | |
| 5,342,070 | 8/1994 | Miller et al. . | |
| 5,342,071 | 8/1994 | Soo | 280/11.22 |
| 5,549,331 | 8/1996 | Yun et al. | 280/843 |
| 5,590,890 | 1/1997 | Rosso et al. | 280/11.22 |
| 5,594,974 | 1/1997 | Wattron et al. | 16/30 |
| 5,848,796 | 12/1998 | Meibock et al. | 280/11.22 |
| 5,918,889 | 7/1999 | Tai | 280/11.22 |

FOREIGN PATENT DOCUMENTS

| | | | |
|---|---|---|---|
| 9012977 | 10/1990 | France | 280/843 |
| 2668072 | 4/1992 | France . | |
| 2103963 | 9/1972 | Germany . | |

*Primary Examiner*—Lanna Mai
*Assistant Examiner*—Kevin McKinley
*Attorney, Agent, or Firm*—Michael I. Kroll

[57] ABSTRACT

A multidirectional in-line roller skate (12) comprising a boot (14) to receive a foot of a skater (16). The boot (14) has a sole (18). A frame (20) is provided. A facility (22) is for securing the frame (20) to a bottom surface of the sole (18) of the boot (14). A plurality of spherical wheel assemblies (24) are also provided. A subassembly (26) is for mounting each spherical wheel assembly (24) in a removable manner to a bottom surface of the frame (20) centrally along a common place, so that each spherical wheel assembly (24) can rotate horizontally along a riding surface (28). An assemblage (30) is for revolving each spherical wheel assembly (24) vertically three hundred and sixty degrees in a clockwise and counterclockwise direction upon the riding surface (28), to allow the skater (16) to perform tight figure skating maneuvers on the riding surface (28).

3 Claims, 4 Drawing Sheets

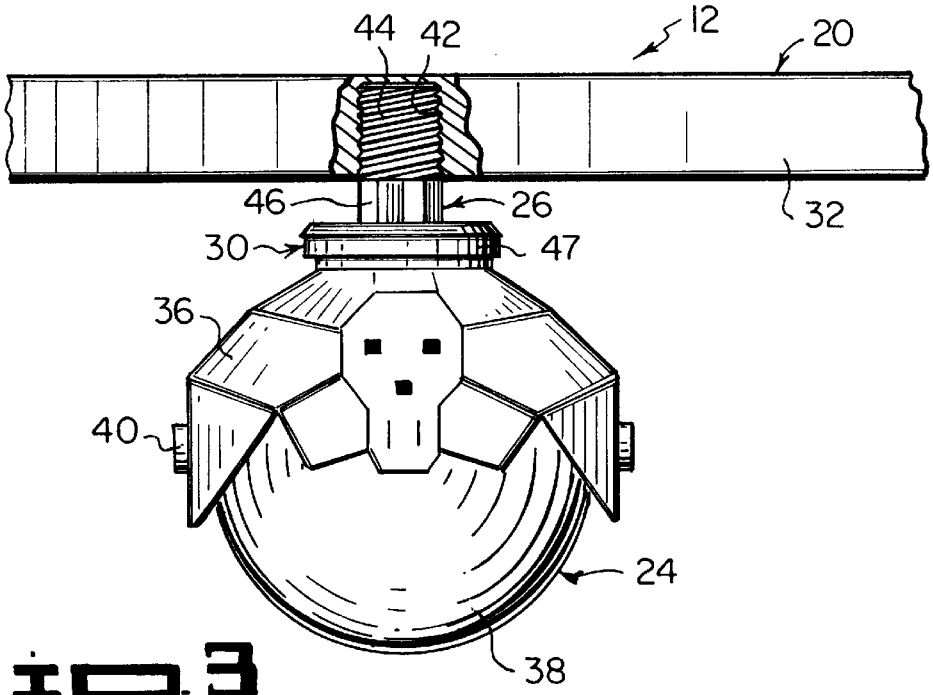
Fig. 3
Fig. 4
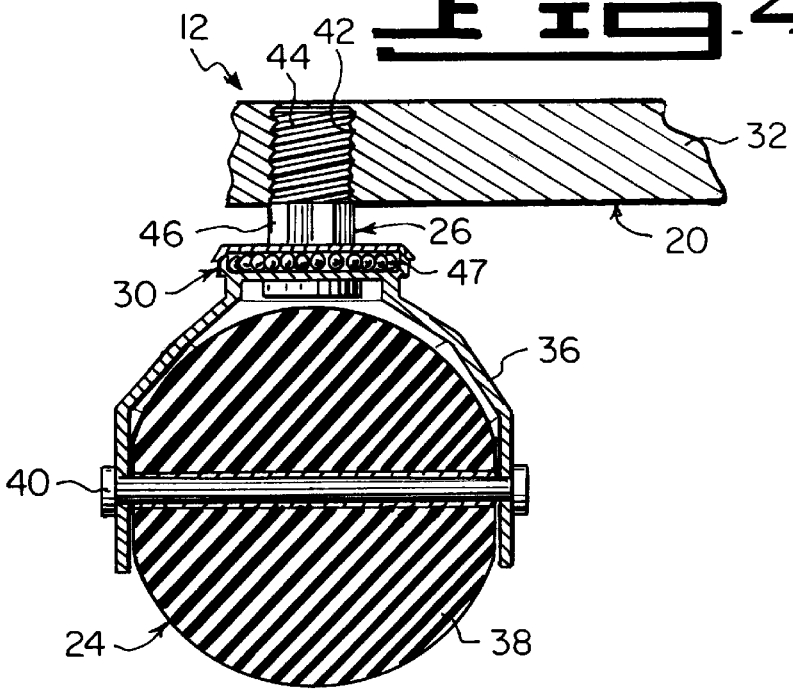

Fig. 5
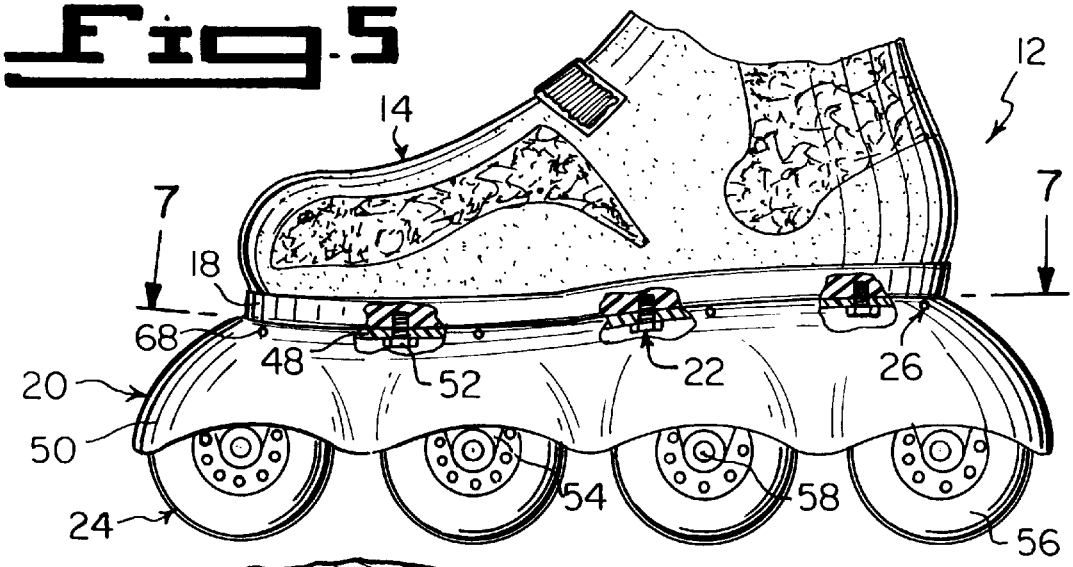
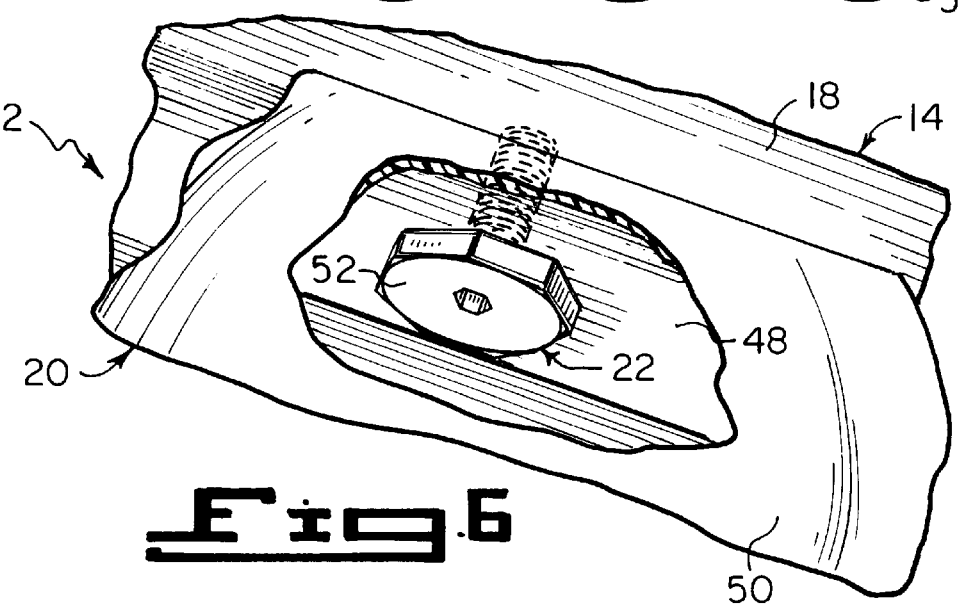
Fig. 6
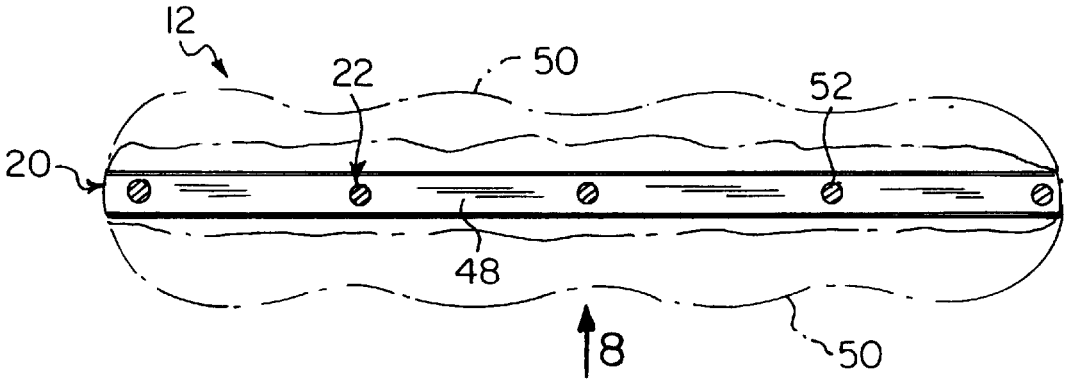
Fig. 7

MULTIDIRECTIONAL IN-LINE ROLLER SKATE

BACKGROUND OF THE INVENTION

1. Field of the Invention

The instant invention relates generally to roller skates and more specifically it relates to a multidirectional in-line roller skate. The multidirectional in-line roller skate contains a plurality of spherical wheel assemblies mounted centrally along a common plane below a boot of a skater. Each spherical wheel assembly has the ability to rotate horizontally along a riding surface as well as to revolve vertically three hundred and sixty degrees in a clockwise and counterclockwise direction on the riding surface, allow the skate to perform tight figure skating maneuvers on the riding surface. The spherical wheel assemblies can very easily be changed to accommodate varying degrees of traction requirements on different riding surfaces, thereby producing low replacement costs, for both the spherical wheels and the spherical wheel assemblies.

2. Description of the Prior Art

Numerous roller skates have been provided in prior art. For example, U.S. Pat. Nos. 1,043,598 to Mollinger; 3,936,061 to Wada and 4,034,995 to Forward et al. all are illustrative of such prior art. While these units may be suitable for the particular purpose to which they address, they would not be as suitable for the purposes of the present invention as heretofore described.

MOLLINGER, ALEXANDER JOHAN

TWO WHEELED ROLLER SKATE

U.S. Pat. No. 1,043,958

A two wheeled roller skate comprising a supporting frame. An arm is pivotally held by the frame and is capable of movement transversely of the frame. A supporting roller is carried by the arm. A guiding roller is carried by the free end of the arm. An arched shaped box carried by the frame is engageable with the guiding roller for imparting movement to the arm.

WADA, NOBUHITO

ROLLER SKATE

U.S. Pat. No. 3,936,061

A roller skate, of the type of two rollers. Two substantially spherical rotary elements are rotatably mounted on a support or chassis along its longitudinal axis, to give the feeling of ice skating to users.

FORWARD, DANIEL

WOOLLEY, GEORGE CARR

DAOUST, DONALD

TANDEM WHEELED ROLLER SKATE HAVING SPHEROIDAL ROLLERS

U.S. Pat. No. 4,034,995

A novel roller skating device includes the combination of a boot having the general appearance of an ice skate boot, including a rear section adjacent the region of the tibia extending beyond the region of the Achilles tendon. The rear section extends along the sides of the boot and curvingly projects above the region of the malleoli. An additional section of the boot surface follows the region of the instep, from a section abutting the rear section, in order to provide rows of lace accepting holes. The rows of lace accepting holes end just above the region of the toe joints. The skating device includes a front roller assembly secured to the toe portion area of the boot, and a rear roller assembly secured to the heel portion area of the boot. Each of the front roller assembly and the rear roller assembly includes a bridge sub-assembly of an inverted generally U-frame shape, including a base and a pair of spaced preferably inwardly prestressed depending wings, and a hollow spheroidal roller having axially disposed, diametrically opposed bearing surfaces, rotatably operatively engaged with respect to the spaced apart wings, the hollow roller being a globular roller comprising a hollow spheroidal, inner, rigid relatively thin walled core of structurally strong material, covered by a coating of a resilient material thereon. The base section of the forward roller assembly is centrally positioned and disposed below the matatarsal head. A rear roller assembly is also secured to the heel portion of the rear assembly. The rear member has a base section centrally positioned and disposed below the calcaneous. The apex of the inverted generally U-shaped members form an axle for the globular rollers for both the front roller assembly and the rear roller assembly.

SUMMARY OF THE INVENTION

A primary object of the present invention is to provide a multidirectional in-line roller skate that will overcome the shortcomings of the prior art devices.

Another object is to provide a multidirectional in-line roller skate that contains a plurality of spherical wheel assemblies mounted centrally along a common plane below a boot of a skater, in which each spherical wheel assembly has the ability to rotate horizontally on a riding surface, as well as revolve vertically three hundred and sixty degrees in a clockwise and counterclockwise direction on the riding surface, allowing the skater to perform tight figure skating maneuvers on the riding surface.

An additional object is to provide a multidirectional in-line roller skate in which the spherical wheel assemblies can very easily be changed to accommodate varying degrees of traction requirements on different riding surfaces, thereby producing low replacement costs, for both the spherical wheels and the spherical wheel assemblies.

A further object is to provide a multidirectional in-line roller skate that is simple and easy to use.

A still further object is to provide a multidirectional in-line roller skate that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is an enlarged front elevational view taken in the direction of arrow 3 in FIG. 1, with parts broken away and in section.

FIG. 4 is an enlarged vertical cross sectional view taken along line 4—4 in FIG. 1.

FIG. 5 is a side elevational view of a second embodiment of the present invention with parts broken away and in section.

FIG. 6 is an enlarged bottom perspective view taken in the direction of arrow 6 in FIG. 5, with parts broken away and in section.

FIG. 7 is a horizontal cross sectional view taken along line 7—7 in FIG. 5, with parts broken away and in phantom.

Similar reference characters denote corresponding features consistently throughout the attached drawings.

DETAILED DESCRIPTION OF THE PREFERRED EMBODIMENTS

Figure 1:
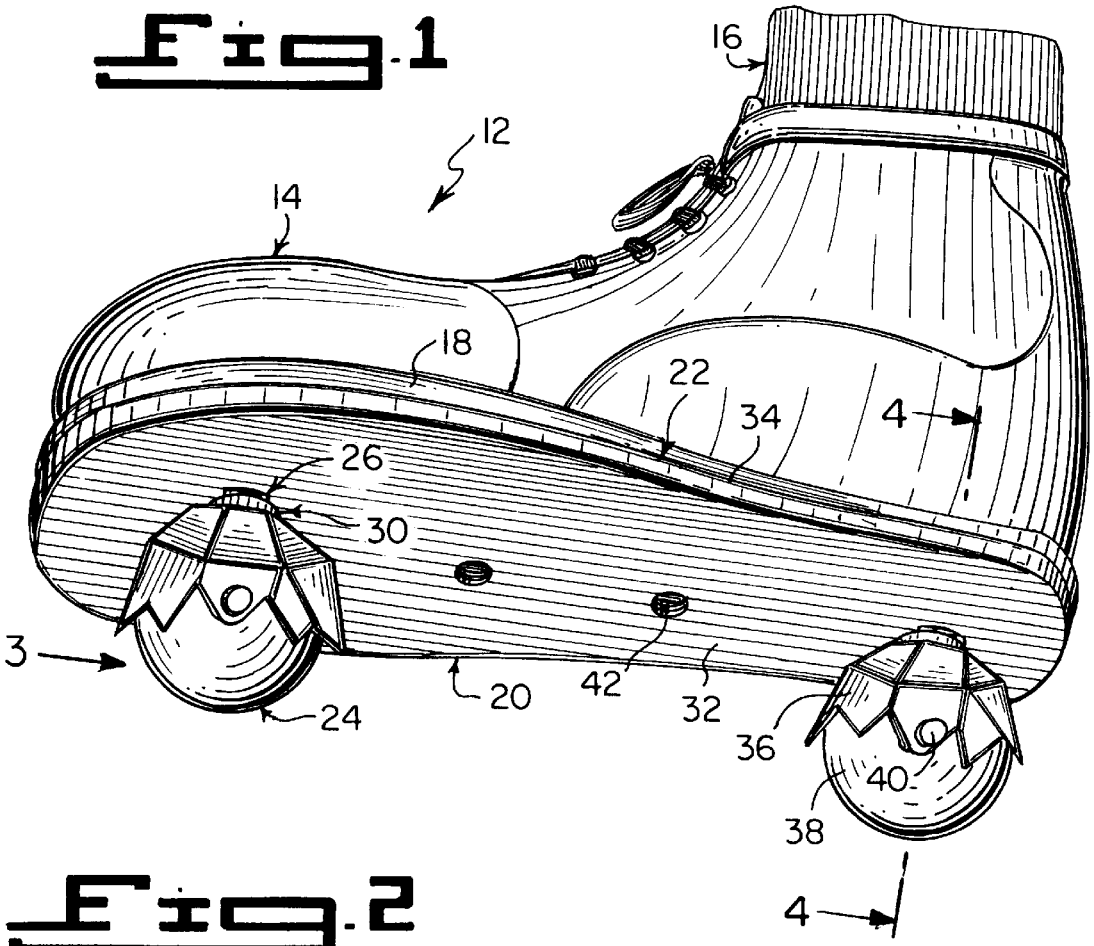
FIG. 1 is a bottom perspective view of a first embodiment of the present invention.
Figure 2:
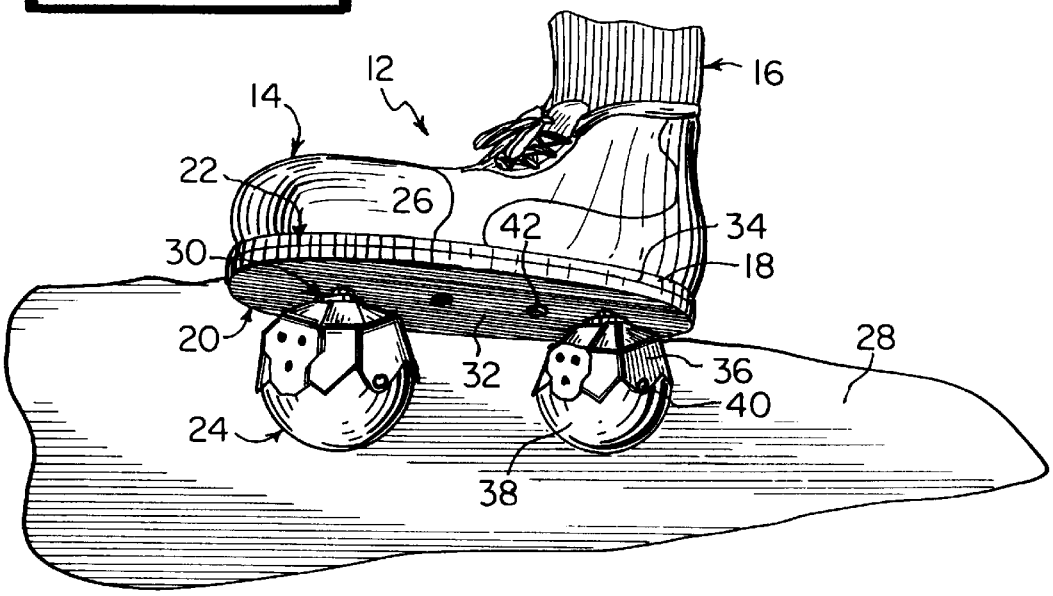
FIG. 2 is a bottom perspective view of the first embodiment placed upon a riding surface.
Figure 8:
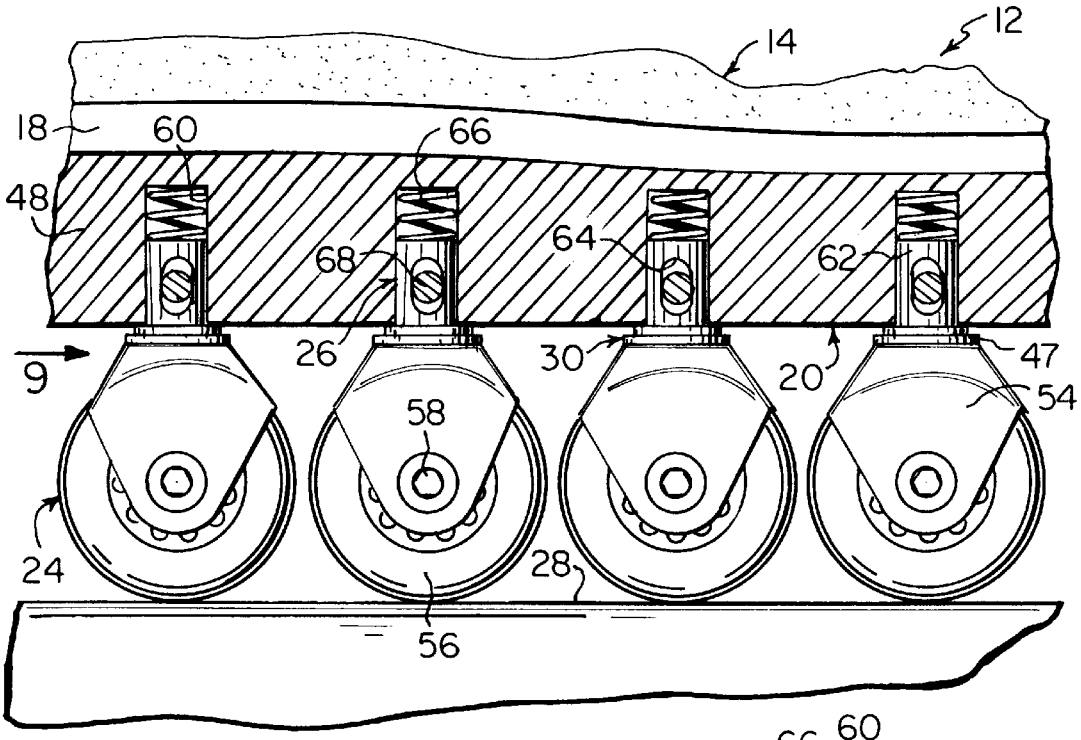
FIG. 8 is an enlarged side elevational view taken in the direction of arrow 8 in FIG. 7, with parts in section, showing the spherical wheel assemblies placed upon a riding surface.
Figure 9:
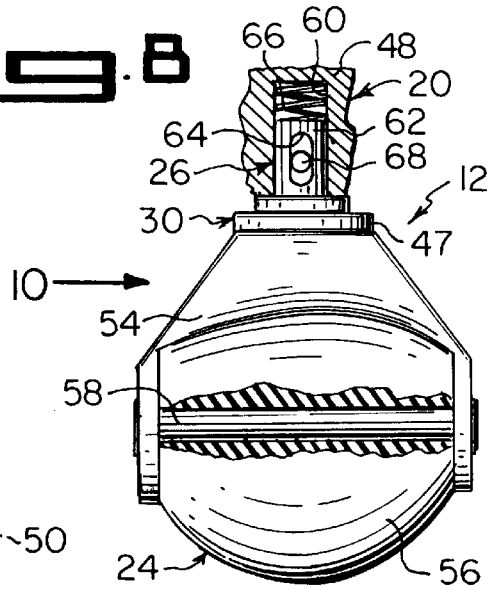
FIG. 9 is a further enlarged front elevational view taken in the direction of arrow 9 in FIG. 8, with parts broken away and in section.
Figure 10:
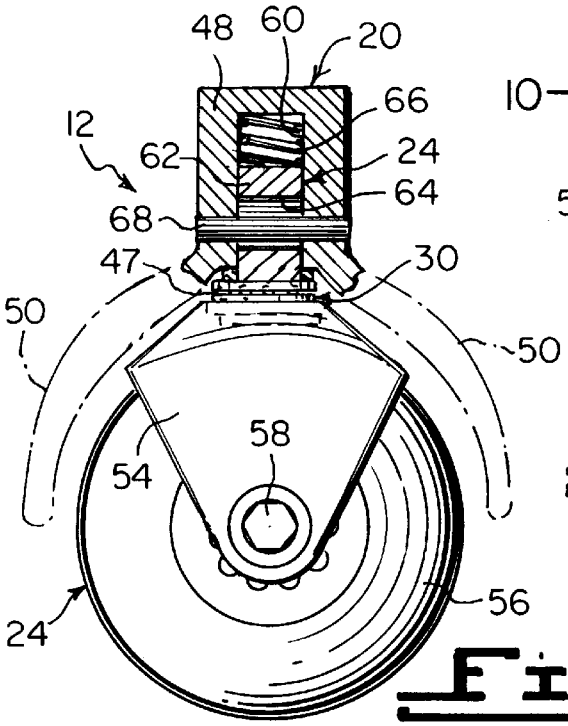
FIG. 10 is a side elevational view taken in the direction of arrow 10 in FIG. 9.

Turning now descriptively to the drawings, in which similar reference characters denote similar elements throughout the several views, FIGS. 1 through 10 illustrate the present invention being a multidirectional in-line roller skate 12. With regard to the reference numerals used, the following numbering is used throughout the various drawing figures.

12 multidirectional in-line roller skate
14 boot of 12
16 skater
18 sole of 14
20 frame of 14
22 securing facility of 14
24 spherical wheel assembly of 14
26 mounting subassembly of 14
28 riding surface
30 revolving assemblage of 14
32 plate for 20
34 adhesive for 22
36 umbrella shield of 24
38 ball shaped roller of 24
40 axle of 24
42 internally threaded hole in 20 of 26
44 externally threaded anchor post on 24 of 26
46 hex shaped shank portion on 44
47 ball bearing race
48 elongated rib for 20
50 curved side shield on 48
52 bolt of 22
54 U-shaped inverted bridge of 24
56 ball shaped roller of 24
58 axle of 24
60 hole in 20 of 26
62 anchor post on 24 of 26
64 transverse oval opening in 62
66 spring of 26 in 60
68 rod of 26

The multidirectional in-line roller skate 12 comprises a boot 14 to receive a foot of a skater 16. The boot 14 has a sole 18. A frame 20 is provided. A facility 22 is for securing the frame 20 to a bottom surface of the sole 18 of the boot 14. A plurality of spherical wheel assemblies 24 are also provided. A subassembly 26 is for mounting each spherical wheel assembly 24 in a removable manner to a bottom surface of the frame 20 centrally along a common place, so that each spherical wheel assembly 24 can rotate horizontally along a riding surface 28. An assemblage 30 is for revolving each spherical wheel assembly 24 vertically three hundred and sixty degrees in a clockwise and counterclockwise direction upon the riding surface 28, to allow the skater 16 to perform tight figure skating maneuvers on the riding surface 28.

The frame 20, as shown in FIGS. 1 through 4, is a plate 32 sized to cover the complete bottom surface of the sole 18 of the boot 14. The securing facility 22 is adhesive 34 applied between the bottom surface of the sole 18 of the boot 14 and a top surface of the frame 20. Each spherical wheel assembly 24 includes an umbrella shield 36, a ball shaped roller 38 and an axle 40 extending horizontally through the umbrella shield 36 and the ball shaped roller 38, so that the ball shaped roller 38 can rotate within the umbrella shield 36.

The mounting subassembly 26, as best seen in FIGS. 3 and 4, consists of the frame 20 having a plurality of vertically spaced apart internally threaded holes 42 extending upwardly from the bottom surface and centrally aligned longitudinally therealong. Each of the spherical wheel assemblies 24 has an externally threaded anchor post 44 extending upwardly therefrom, to engage with one of the internally threaded holes 42 in the frame 20.

Each externally threaded anchor post 44 includes a hex shaped shank portion 46 between the frame 20 and the spherical wheel assembly 24, so that a wrench can be used to tighten and loosen the externally threaded anchor post 44 in the internally threaded hole 42 of the frame 20. The revolving assemblage 30 consists of each of the spherical wheel assemblies 24 having a ball bearing race 47 at a top end connected to a bottom end of one mounting subassembly 26.

In FIGS. 5 through 10, the frame 20 is an elongated rib 48 to extend longitudinally along a bottom surface of the sole 18 of the boot 14. The elongated rib 48 includes a pair of curved side shields 50 extending downwardly therefrom on opposite sides of the spherical wheel assemblies 24. The securing facility 22 includes a plurality of bolts 52, which thread through the frame 20 and into the sole 18 of the boot 14. Each spherical wheel assembly 24 comprises a generally U-shaped inverted bridge 54, a ball shaped roller 56 and an axle 58 extending horizontally through the bridge 54 and the ball shaped roller 56, so that the ball shaped roller 56 can rotate within the bridge 54.

The mounting subassembly 26 consists of the frame 20 having a plurality of vertically spaced apart holes 60 extending upwardly from the bottom surface and centrally aligned longitudinally therealong. Each of the spherical wheel assemblies 24 has an anchor post 62 with a transverse oval opening 64 therethrough, extending upwardly therefrom to be inserted within one of the holes 60 in the frame 20. A plurality of springs 66 are provided. Each spring 66 is placed within one of the holes 60 in the frame 20 above one anchor post 62. A plurality of rods 68 are also provided. Each rod 68 is inserted transversely through the frame 20 and the oval opening 64 in one anchor post 62. The anchor post 62 will be retained and biased in one hole 60 in the frame 20, to allow the spherical wheel assemblies 24 to move up and down when rotating horizontally along the riding surface 28. The revolving assemblage 30 in FIGS. 5 through 10, is identical to the revolving assemblage 30 in FIGS. 1 through 4, which is the ball bearing race 47.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A multidirectional in-line roller skate comprising:

a) a boot to receive a foot of a skater, said boot having a sole;

b) a frame;

c) means for securing said frame to a bottom surface of said sole of said boot;

d) a plurality of spherical wheel assemblies;

e) means for mounting each said spherical wheel assembly in a removable manner to a bottom surface of said frame centrally along a common axis comprising an axle extending horizontally through each said spherical wheel permitting each said spherical wheel to rotate about said axle and an umbrella shield for supporting said axle;

f) said mounting means further comprising an upwardly extending solid anchor post and a ball bearing race in a horizontal plane surrounding said post connecting said umbrella shield to said post to permit said axle and spherical wheel to rotate 360 degrees about a vertical axis to allow the skater to perform tight figure skating maneuvers on the riding surface; and g) said frame having a plurality of vertically spaced apart holes extending upwardly from the bottom surface and centrally aligned longitudinally therealong, each anchor post has a transverse oval opening therethrough extending upwardly to be inserted within one of said holes in said frame, a spring in each hole above the anchor post, and a plurality of rods each inserted transversely through said frame and said oval opening in each anchor post, so that said anchor post will be retained and biased in its respective hole to allow said spherical wheel assemblies to move up and down when rotating horizontally along the riding surface.

2. A multidirectional in-line roller skate as recited in claim 1, wherein said frame is a plate sized to cover the complete bottom surface of said sole of said boot.

3. A multidirectional in-line roller skate as recited in claim 1, wherein said securing means is adhesive applied between the bottom surface of said sole of said boot and a top surface of said frame.

* * * * *